US005211297A

United States Patent [19]

Vandervalk

[11] Patent Number: 5,211,297

[45] Date of Patent: May 18, 1993

[54] FOLDABLE CRANE

[76] Inventor: James Vandervalk, P.O. Box 1178, Fort MacLeod, Alberta, Canada, T0L 0Z0

[21] Appl. No.: 707,743

[22] Filed: May 30, 1991

[30] Foreign Application Priority Data

Feb. 22, 1991 [CA] Canada ..... 2036895

[51] Int. Cl.[5] ..... B66C 23/26

[52] U.S. Cl. ..... 212/182; 212/187; 212/231; 212/240; 212/264

[58] Field of Search ..... 212/179-180, 212/182, 187, 223, 227, 230-232, 237, 238-239, 244, 240, 252, 255, 260-262, 264, 266-267

[56] References Cited

U.S. PATENT DOCUMENTS

| | | | |
|---|---|---|---|
| 323,352 | 7/1885 | Meltzer | 212/264 |
| 1,558,636 | 10/1925 | Rutan | 212/182 |
| 1,897,383 | 2/1933 | Burgayne | 212/252 |
| 2,410,777 | 11/1946 | English et al. | 212/252 |
| 2,487,305 | 11/1949 | Bridegroom | 212/252 |
| 2,701,649 | 2/1955 | Hellstrom | 212/182 |
| 2,828,867 | 4/1958 | Frisk | 212/252 |
| 3,048,371 | 8/1962 | Klimek, Jr. | 254/362 |
| 3,638,866 | 2/1972 | Hippach | 212/231 |
| 4,049,238 | 9/1977 | Brown | 212/264 |
| 4,241,837 | 12/1980 | Suverkrop . | |
| 4,267,934 | 5/1981 | Vernay . | |
| 4,419,038 | 12/1983 | Pendergraft | 414/543 |
| 4,427,120 | 1/1984 | Schoeffler . | |
| 4,508,233 | 4/1985 | Helms . | |
| 4,540,096 | 9/1985 | Orvis . | |
| 4,623,067 | 11/1986 | Hejlik . | |
| 4,653,654 | 3/1987 | McDaniel . | |
| 4,700,851 | 10/1987 | Reeve . | |

FOREIGN PATENT DOCUMENTS

| | | | |
|---|---|---|---|
| 839553 | 4/1970 | Canada . | |
| 840327 | 5/1970 | Canada . | |
| 1067862 | 12/1979 | Canada . | |
| 2160170 | 12/1985 | United Kingdom | 212/187 |

*Primary Examiner*—Joseph F. Peters, Jr.
*Assistant Examiner*—R. B. Johnson
*Attorney, Agent, or Firm*—McFadden, Fincham, Marcus & Anissimoff

[57] ABSTRACT

There is disclosed a mobile crane having at least one hollow load bearing support member which is rotatable about a base. The load bearing support member is pivotally connected to a hollow boom which telescopically receives a plurality of secondary hollow and interengageable booms. The load bearing support member and boom are pivotally connected by an inwardly collapsible support. The crane cable is connected to a drive source and extends within the hollow booms and load bearing support member and is releasably retained by at least one boom. The crane may be automatically unfolded from a storage position when the boom is substantially parallel to the mast, to an operational position when the boom is angularly inclined to the load bearing support member.

14 Claims, 3 Drawing Sheets

FOLDABLE CRANE

FIELD OF THE INVENTION

This invention relates to load lifting apparatus and in particular to foldable and telescopic cranes adapted for mobile use.

BACKGROUND OF THE INVENTION

Crane assemblies are well known in the art and encompass various modifications in structure. Many arrangements are restricted to mounting on a vehicle and employ extremely large hydraulically actuated booms, masts, etc.

The portable arrangements are restricted in that they generally too require large apparatus and are somewhat limited in functional diversity.

Such known arrangements include the device disclosed in U.S. Pat. No. 4,241,837. The document discloses an articulated boom crane which is convertible to a straight boom crane arrangement. A secondary boom is coupled to a main boom and inclined adjustable extensible members. However, the conversion to a straight boom requires the user position stop plates on the structure, which requires considerable time and effort. Additionally, the crane is hydraulically operated and requires trained manipulation to effect proper operation.

U.S. Pat. No. 4,508,233 describes a compact crane having a telescopically adjustable mast and a pivotally linked permanent boom. Located within the permanent boom is a secondary boom which is adjustable within the permanent boom. This arrangement is useful for limited applications, since the apparatus is manually operable and requires extensive adjustment and securing prior to use.

Brown, in Canadian Patent No. 1,067,862, discloses an extension for main booms comprising a pair of boom extension sections. One of the sections, i.e. the first main boom is movable from a storage to operating condition and similarly the second boom is movable from a storage position adjacent the first main boom to an operating condition when extensible members extend the length of the boom.

Having regard to the limitations of the prior art arrangements, there exists a need for a mobile and portable light weight crane having components which may be readily converted from a storage position to an operational position using tension and further which may be fully rotated under load or no-load conditions. Applicant, with the present invention, addresses this need.

SUMMARY OF THE INVENTION

According to one object of the present invention, there is provided a mobile crane comprising: at least one load bearing support member adapted for mounting to a base member; at least one boom member pivotally connected to the at least one load bearing member; and collapsible means for supporting the one boom member in a first operative position and for permitting the boom member to be displaced from the operative position to a second storage position adjacent the at least one load bearing support member.

The load bearing support member, also referred to in the art as a mast, may comprise a channel-shaped member which pivotably connects a channel-shaped primary boom member.

The primary boom member includes a plurality of hollow and telescopically extensible secondary boom members all of which are mutually interengageable.

The collapsible means, in one form comprises a plurality of sections extending between and pivotally connected with the load bearing support and the primary boom member.

The collapsible means include at least adjustable members for adjusting the length of the individual sections and a hollow section to receive the adjustable member.

The hollow section preferably includes a portion to abut and lock against a pivotally connected section of the collapsible means when in a supported position for locking the same in an extended position.

In a collapsed form, the collapsible means preferably is contained within the hollow boom and load bearing support member.

A further object of the present invention is to provide a mobile crane comprising: base means having at least one opening therein; at least one channel-shaped load bearing support member having first and second opposed ends, the first end being pivotally connected to an end of the at least one channel-shaped boom member, the second end being adapted for rotatable reception within the at least one opening of the base means; and cable means for supporting a load extending from within the base means and within the at least one channel-shaped boom member and the at least one hollow load bearing support member; whereby the at least one channel-shaped bearing support member is rotatable about a vertical axis relative to the base means.

The load bearing support member, at a lower end thereof includes, in one form, a suitable projection extending downwardly and axially therefrom and includes an opening extending therethrough. The projection may be of any shape provided it cooperates with the base means and permits communication therewith for reception therein and facilitates rotation therein.

In one form, the base means may include winch means therein and cable means extending from the winch means through an opening which receive the projection of the load bearing support member, and eventually through the channel-shaped support member and boom members.

The base means may additionally include flanges for mounting to a vehicle via bolts, etc.

In another form, the projection of the load bearing support member may be received within a cooperating opening of a vehicle suitable for mounting the support member.

Winch and cable means known to those skilled in the art may be used with the present invention.

Applicant has found that the use of a projecting member on the load bearing support member allows the same to be readily disengaged from the base for ease of handling during transportation.

In addition, the channel-shaped members permit the load bearing support to be rotated about a vertical axis relative to the base means without tangling the cable means extending therein.

Suitable pulleys positioned within the channel-shaped members permit smooth transportation of the cable therein.

Yet another object of the present invention is to provide a foldable crane comprising: base means having at least one opening therein; at least one channel-shaped boom member; at least one channel-shaped bearing support member having first and second opposed ends, the first end being pivotally connected to an end of the at least one channel-shaped boom member, the second end being adapted for reception within the base means; a collapsible support means pivotally connected between the at least one boom member and the at least one channel-shaped bearing support member; the base member further including cable means and actuatable winch means associated therewith, the cable means extending through the base means, the at least one channel-shaped load bearing support member, and the at least one channel-shaped boom member, the cable means being releasably engageable with the at least one channels-shaped boom member, whereby upon actuation of the winch means, the cable means tensionably effects unfolding of the at least one channel-shaped boom member from a first non-operative position adjacent the channel-shaped load bearing support member to an operative position wherein the at least one channel-shaped boom member is angularly inclined relative to the at least one load bearing support member.

Still another object of the present invention is to provide a mobile crane comprising, in combination: at least one hollow boom member; at least one channel-shaped load bearing support member being pivotally connected to an end of the at least one channel-shaped boom member, the second end being adapted for rotatable reception within a mounting means; collapsible means for supporting the at least one boom member in a first operation position and for permitting the boom member to be displaced from the operative position to a second storage position adjacent the at least one load bearing support member; and a support vehicle having mounting means associated therewith and adapted to receive the second end of the load bearing support member.

In an optional feature, the lower end of the load bearing support adjacent the base means may include a TEFLON® gasket, etc. to permit easy rotation of the mast on the base. In addition, thrust bearings may be incorporated.

Further, the rotation of the load bearing support relative to the base means may be effected by incorporating a suitable actuation means, e.g. gear assemblies, etc. enabling the load bearing support to be locked into various positions.

In a further optional feature, the collapsible means may include quick release means for collapsing the same and hence the inclined boom rapidly.

In a further embodiment, the crane may include a remote control means for actuating the crane.

In yet another alternate embodiment, the base may include gear means to effect rotation of the mast.

Having thus generally described the invention, reference will now be made to the accompanying drawings, illustrating preferred embodiments.

DETAILED DESCRIPTION OF THE PREFERRED EMBODIMENTS

Figure 1:
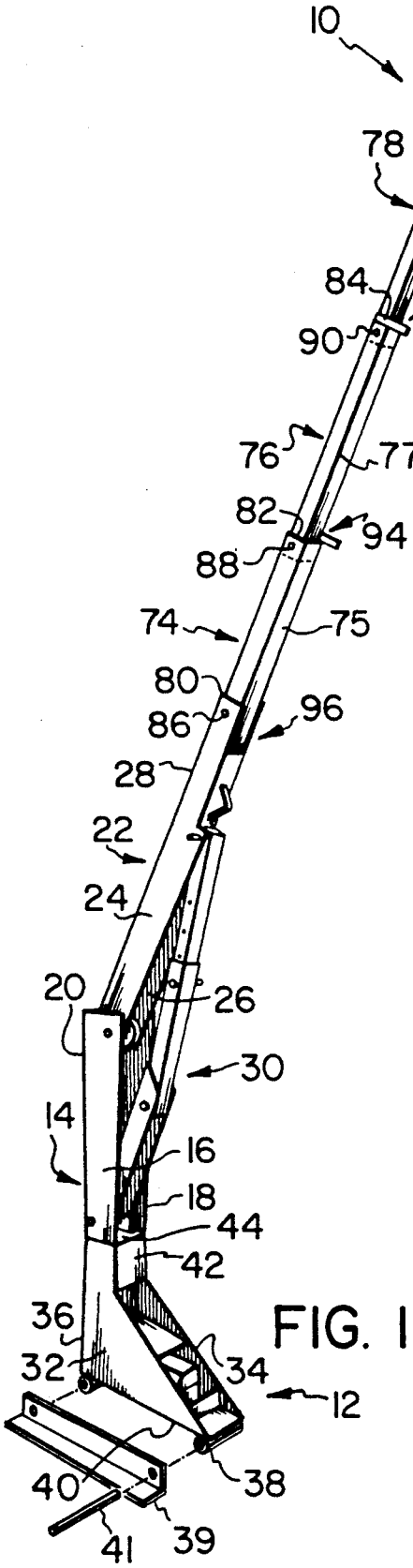
FIG. 1 is a perspective view of the crane of the present invention in a fully extended, operational position.
Figure 2:
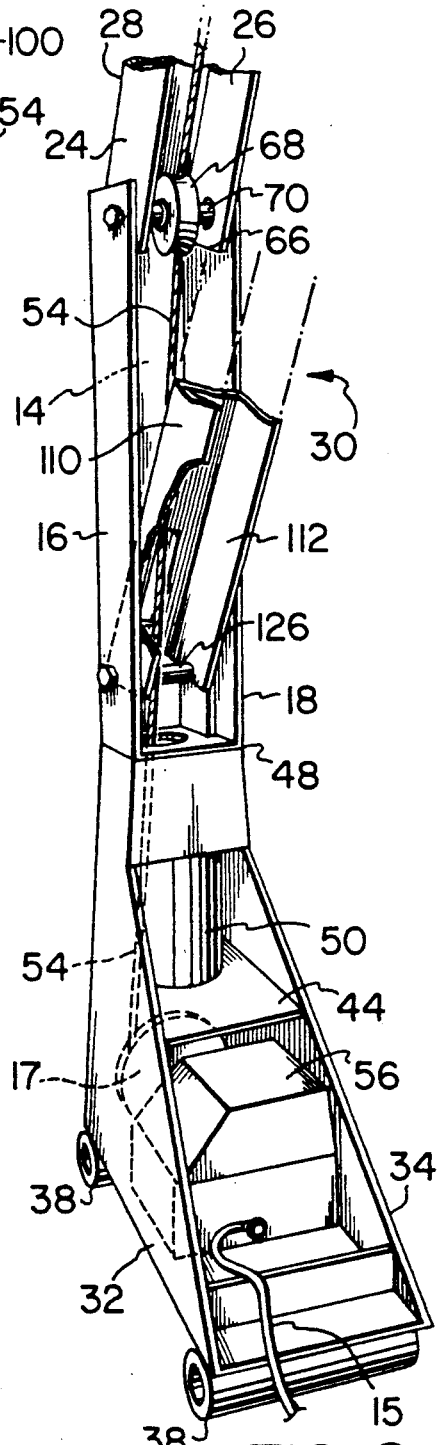
FIG. 2 is a front view of the lower end of the crane.

Referring to FIG. 1, shown is a perspective view of the crane of the present invention, generally indicated by numeral 10. The crane 10, shown in an extended, operational position includes a base 12, a mast 14 having spaced apart walls 16 and 18 and back wall 20, at least one boom which includes a primary boom 22 and other boom members 74, 76 and 78, with spaced apart walls 24,26 and back wall 28, and at least one collapsible support means 30 associated with the boom 22 and mast 14. The base 12, in one form, includes a pair of spaced apart side walls 32,34 and a back wall 36. In this form, the base 12 preferably includes mounting means 38, e.g. sleeves which extend transversely of the bottom 40 between side walls 32,34 and back wall 36 of the base 12. The sleeves 38 preferably cooperate with pins 41 which extend through the sleeves and allow the base 12 of the crane to be mounted to, for example, apertured angle irons 39. As such, the crane 10 may be mounted on a vehicle equipped with angle irons 39 or adapted to accommodate the angle irons 39.

Figure 3:
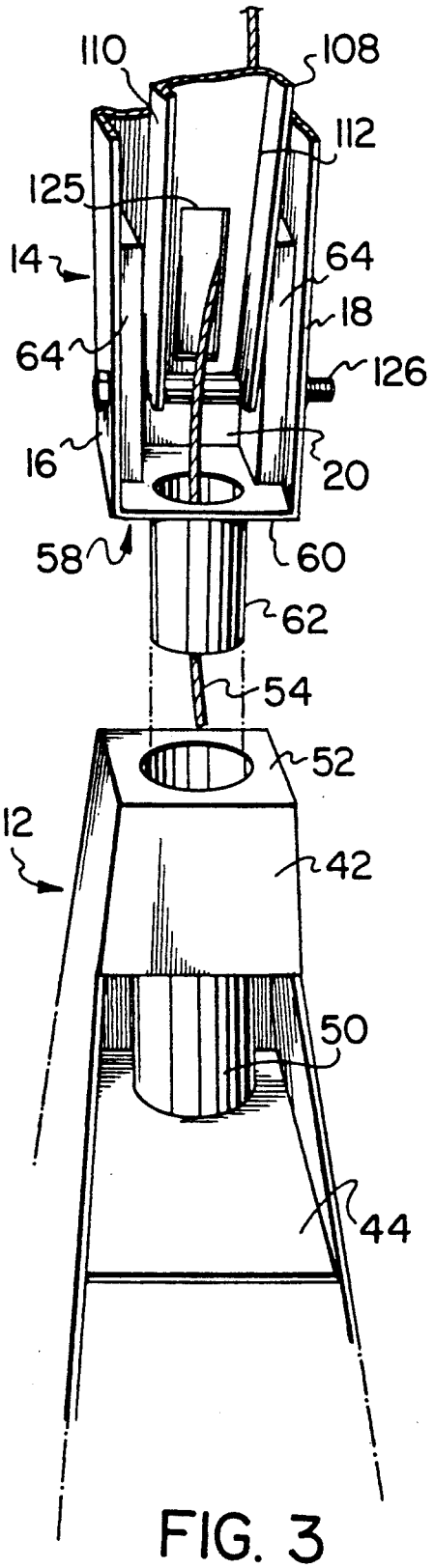
FIG. 3 is an exploded view of FIG. 2.

The base 12, however, may be easily modified facilitating mounting to any surface for other applications. The base 12 preferably includes, in this form, structural features which enhance the mechanical integrity of the spaced walls 32,34, illustrated as plates 42 and 44 extending between the side walls 32 and 34 and downwardly from the top 48 of the base 12. It is particularly preferred that the base 12 include a tubular guide receiving member 50 extending downwardly from the top 48 of the base 12 and terminating at plate 44 perpendicularly oriented thereto between walls 32 and 34. The top 48 preferably includes a plate 52 apertured and in alignment with tubular receiving guide member 50 as shown in FIG. 3. The guide receiving member 50 and apertured top 52 of the base 12 allow a cable 54, extending from actuation means, e.g. a winch 56 optionally situated within the spaced walls 32 and 34 of the base 12, to communicate, via pulley 17, with the remaining structure of the crane hereinafter described. The winch 56 includes power lead 15/ which may be connected to a remote control power source.

It will be understood that the base, mast and boom will comprise a material known in the art sufficiently strong for a load bearing device e.g. heavy gauge steel.

In FIG. 3, an exploded view of the mast 14 and base 12 is shown, more clearly illustrating the relationship between the same. The lower end 58 of the mast 14 includes a bottom wall 60, preferably apertured and fixedly secured by suitable means, e.g. welding, to walls 16,18 and 20 of the mast 14. Downwardly projecting from the apertured wall 60, there is preferably included a tubular guide member 62 which is received within receiving member 50 of base 12. In this arrangement, the mast is fully rotatable about a vertical axis within the base 12, while the winch cable 54 extends therethrough. Additionally, the mast 14 preferably includes spacer means 64 projecting upwardly from bottom wall 60 adjacent sides 16 and 18 which may comprise e.g. a pair of plate members suitably interiorly associated with the side walls 16 and 18. The spacer means 14 allow a first support member of the collapsible support means 30 to be spaced from the walls 16,18, hereinafter described.

Referring to FIGS. 1 through 4, the mast 14 and primary boom 22 are channel-shaped as defined by walls 16,18,20 and 24,26,28 respectively and preferably the width of the channel-shaped opening of the mast 14 is greater than that of the primary boom 22 and sufficient in depth to accommodate the collapsible support means 30 and at least a portion of the boom 22 therein in a folded, non-operational position hereinafter described.

Located interiorly of the channel-shaped boom 22 and proximate the lower end 66 thereof, there is a pulley 68 (best shown in FIG. 4) freely rotatable on a pin 70 traversing the distance between the side walls 24,26 of the boom 16 and extending outwardly therefrom to extend through side walls 16,18 of the mast 14 while spacing the boom 22 interiorly therefrom. The back walls 20,28 of mast 14 and boom 22 are, of course, sufficiently spaced apart by the pivotal connection 70 to enable unimpeded pivoting motion. The upper end of the primary boom 22, preferably includes a plurality of boom members 74,76 and 78, shown in extended form in FIG. 1 and telescopically received within each other and primary boom 22. The upper ends 80,82,84 of booms 22,74 and 76 preferably include apertures 86,88 and 90 which register in alignment with similar apertures (not shown) of the lower ends 92,94 (shown in dashed lines) and 96 of secondary boom members 78,76 and 74. The booms may be interengaged by any suitable means, e.g. cotter pins or spring loaded pin arrangements within each boom. Each of the secondary boom members 74,76 and 78 preferably are rectangular or square in cross-section with bottom walls 75,77 and 79, respectively which allow sufficient strength to be imparted to the members. Although this is preferred, obvious variations in both boom member cross-section and bottom wall formation will achieve an adequate result. Primary boom 22 also includes a wall 104 extending from the end 80 thereof to a pivot point 108 for the collapsible means 30. The wall 104 includes a cable hook retainer 106 spaced from end 80, which is used in the unfolding of the crane from a storage position. The terminal boom 78 preferably includes a pulley 100 operatively associated with the end 102 thereof. The cable 54 extending through the mast 14, and boom members 22,74,76 and 78 can then be pulled or extended therethrough for lifting or lowering a load engageable with a cable hook 102,103 at the end thereof. Although the crane 10 includes three boom members, suitable dimensional modifications of the crane will allow several more members to be included. Additionally, all of the secondary boom members 74,76 and 78 need not be extended in order for the crane 10 to be operated; one, all or none of the secondary boom members may be extended in operation.

Figure 4:
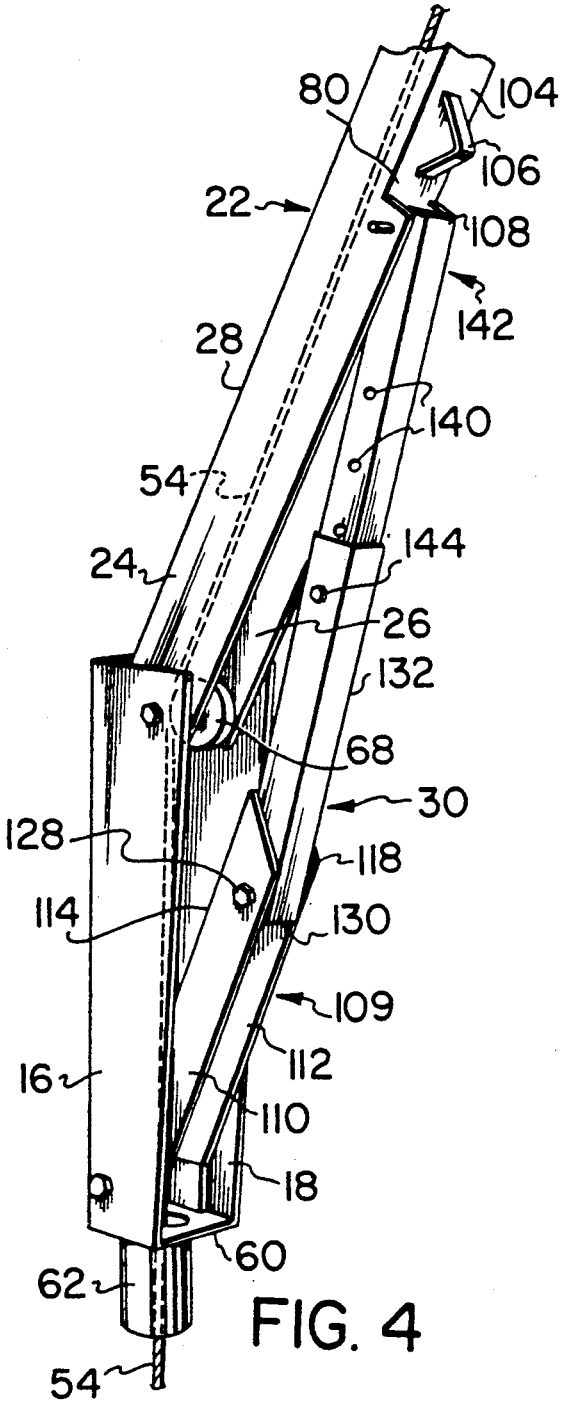
FIG. 4 is an enlarged perspective view of the support means of the crane.

With further reference to FIGS. 1 through 4, the collapsible support means 30 extending between the mast 14 and primary boom 22 can comprise a suitable arrangement of pivotally linked retractable and extensible members, e.g. hydraulic cylinders, but in a preferred form, the collapsible support means 30 includes a first hollow locking member 109 generally of U-shaped cross-section with spaced apart walls 110,112 and a back wall 114. The upper end preferably includes a downwardly tapering portion 118. The lower end illustrated best in FIG. 3, includes an aperture in each wall 110 and 112 which register with apertures (not shown) in both the spacer means 64 and apertures in side walls 16 and 18 of mast 14. A pin 126 extending through the series of apertures allows pivotal movement of locking member 109. Additionally, there is preferably included an opening 125 spaced from the lower end, which allows the cable 54 to extend therethrough leaving the same unimpeded by the action of the collapsible support means 30. As best seen in FIG. 4, the upper end includes, spaced from the end, a pivotal connection of locking member 109 with a lower end 130 of an intermediate member 132 by pin 128. When extended, the downwardly extended portion 118 of locking member 109 "locks" against the intermediate member 132, which is preferably hollow. The intermediate member 132 may be rectangular or square in cross-section and, preferably spaced from the upper end there are included apertures (not shown) extending therethrough. These apertures register with one of the plurality of spaced apart apertures 140 extending through a second support member 142 which is telescopically received within the intermediate member 132. A releasably engageable pin 144 allows the intermediate member 132 and second support member 142 to be adjustably engaged. The upper end of second support member 142 includes a pivotal connection 108 between the walls 24 and 26 of primary boom 22.

Referring to FIGS. 1, 5, 6 and 7, the operation of the crane at different stages is illustrated.

Figure 5:
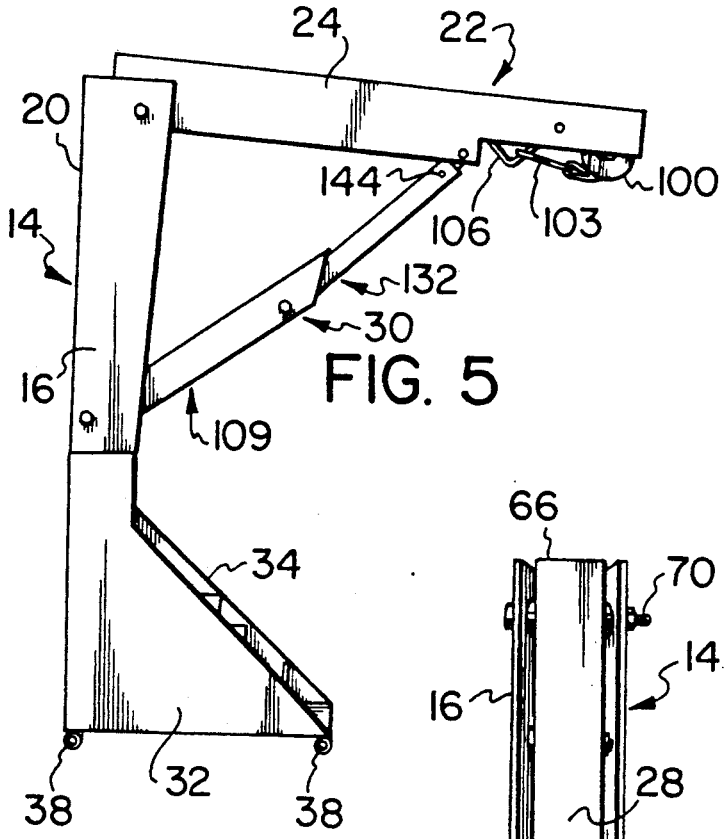
FIG. 5 is a side view of the crane in a partially extended position.
Figure 6:
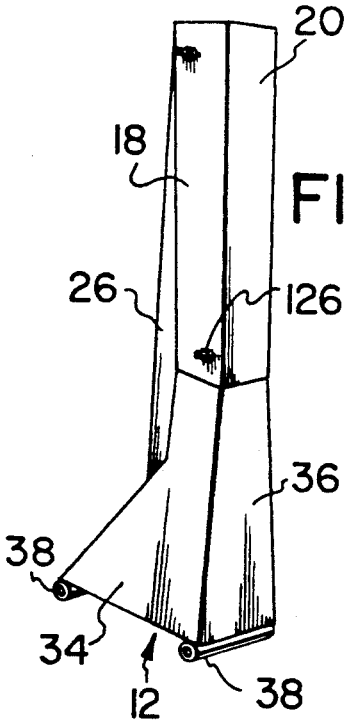
FIG. 6 is a perspective view of the crane in a storage position.
Figure 7:
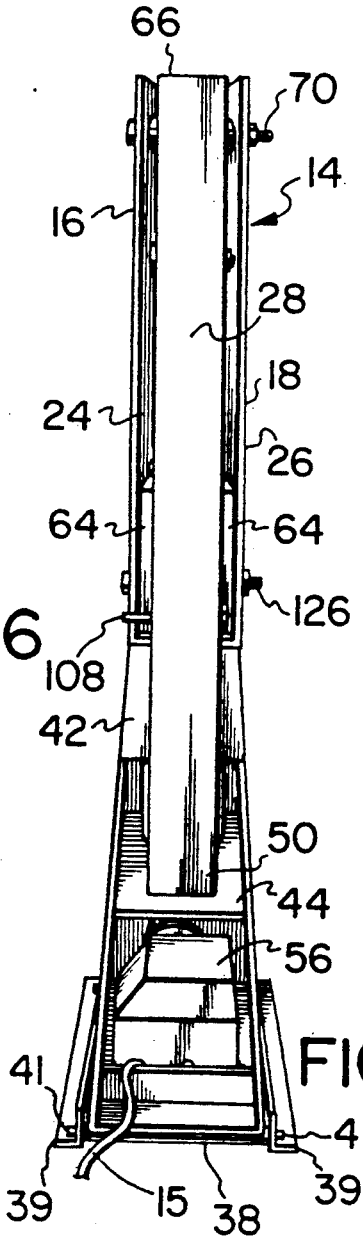
FIG. 7 is a front view of the crane in a storage position.

FIGS. 6 and 7 show the crane 10 in a first storage position wherein the boom members 74,76,78 are retracted into the primary boom 16, the boom adjacent the mast 16 and the cable hook 103 is engaged with the hook retainer 106. Upon actuation of the winch 56, the cable 54 tightens with increasing force to the point of effecting unfolding of the primary boom 22 from a portion adjacent the mast 14 to a position where the boom 22 is angularly inclined thereto as shown in FIG. 5. The locking member 109 and intermediate member 132, which contains the second support member 142, therein simultaneously unfold to support the boom 22 and mast 14. The locking member 109 contained between side walls 110 and 112 the intermediate member 132 pivotally unfolds outwardly and downwardly from within the walls 16 and 18 of mast 14, while the intermediate member 132 pivotally unfolds upwardly and outwardly. The locking member 109 "locks" against intermediate member 132 thereby limiting further pivoting movement between the members. The crane 10, may be operated in a position shown in FIG. 5 by simply releasing hook 103 from retainer 106, engaging pin 144 with the apertures of the intermediate member 132 and second support member 142. Similarly, the primary boom 22 may be locked into position by inserting a pin into aperture 86 of the primary boom 22 which registers with aperture 90 of secondary boom member 78 when secondary boom members 74 and 76 are retracted. For further extension, hook 103 is secured to retainer 106, the pin 144 is removed, the actuation of the winch 56 is continued, while second support 132 telescopes outwardly from intermediate member 132. The result is a greater angle of inclination of primary boom 22 relative to mast 14. The boom members may be selectively telescoped and engaged with pins, herein previously described, to a desired height.

In a collapsing or folding procedure, the necessary pins are removed from any extended boom members, hook 103 is engaged with retainer 106 and the winch 56 is actuated to retract the extended boom member or members. Thereafter, the crane can be moved to its non-operative position in an inverse manner to the unfolding procedure.

In applications where a vehicle includes mounting means for cooperation with the sleeve 38 and pins 41 of the base 12, one pin 41 may be pulled from a sleeve 38 and the entire crane 10 pivoted downwardly or, alternatively, both pins may be removed and the crane 10 laid flat.

As those skilled in the art would realize these preferred illustrated details can be subjected to substantial variation, without affecting the function of the illustrated embodiments.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A foldable crane comprising, base means having an opening therein;

at least one channel-shaped boom member having first and second opposed ends;

at least one channel-shaped load bearing support member having opposed ends, one of said ends being pivotally connected to said first end of said boom member, a second end being adapted for rotatable reception within said opening of said base means;

collapsible means for supporting said boom member in a first operative position and for permitting said boom member to be displaced from said operative position to a second storage position adjacent said at least one load bearing member support member, said collapsible means including elongate first and second cooperating support members each having opposed ends and a locking member adapted to lock against said second member when said boom member is in said operative position, said locking member having an upper end and a lower end, said upper end being a tapered end, said lower end including an aperture to receive a winch cable therein.

2. The foldable crane as defined in claim 1, wherein said locking member is a channel-shaped member.

3. The foldable crane as defined in claim 2, wherein said locking member is pivotally connected for movement within and out of said load bearing support member.

4. The foldable crane as defined in claim 1, wherein said collapsible support means is inwardly collapsible.

5. The foldable crane as defined in claim 1, wherein first end of said locking member is pivotally mounted within said channel-shaped load bearing support member at said second end thereof.

6. The foldable crane as defined in claim 1, wherein said lower end of said locking member is pivotally connected to an end of the first cooperating support member.

7. The foldable crane as defined in claim 6, wherein said locking member pivots downwardly and outwardly relative said load bearing support member to said operative position.

8. The foldable crane as defined in claim 6, wherein said first cooperating member pivots upwardly and outwardly relative to said load bearing support member to said operative position.

9. A foldable crane comprising:

base means having at least one opening therein;

at least one channel-shaped boom member pivotally movable between operative and non-operative positions, said boom member having first and second opposed ends;

at least one channel-shaped load bearing support member having first and second opposed ends, said first end of said support member being pivotally connected to one of said first or second ends of said boom member, said second end of said support member being adapted for reception within said opening of said base means;

a collapsible support means, said collapsible support means including a locking member pivotally connected to said load bearing support member, a hollow intermediate member pivotally connected to said locking member, a support member telescopically mounted in said intermediate member, means pivotally connecting said support member to said boom member, said locking member adapted to lockingly engage said intermediate member;

said base member further including cable means and actuatable winch means associated therewith;

retainer means mounted on said boom member for releasably receiving said cable means;

means for guiding said cable means from said winch means through said base means, locking member, load bearing support member and boom member to said retainer means;

whereby upon actuation of said winch means said cable means tensionably effects unfolding of said boom member from the non-operative position adjacent said load bearing support member to an operative position wherein said boom member is angularly inclined relative to said load bearing support member.

10. The foldable crane as defined in claim 9, wherein said locking member includes a tapering end at an upper end thereof.

11. The foldable crane as defined in claim 10, wherein said locking member is a channel-shaped member.

12. The foldable crane as defined in claim 11, wherein said locking member is pivotally connected for movement within and out of said loading bearing support member.

13. The foldable crane as defined in claim 10, wherein said locking member includes an aperture adapted to receive a winch cable therethrough.

14. The foldable crane as defined in claim 9, wherein said collapsible support means is inwardly collapsible.

* * * * *